US008290686B2

(12) United States Patent
Kang et al.

(10) Patent No.: US 8,290,686 B2
(45) Date of Patent: Oct. 16, 2012

(54) METHOD FOR CONTROLLING COMBUSTION MODE TRANSITIONS FOR AN INTERNAL COMBUSTION ENGINE

(75) Inventors: Jun-Mo Kang, Ann Arbor, MI (US); Hanho Yun, Oakland Township, MI (US); Allen B. Rayl, Waterford, MI (US); Vijay Ramappan, Novi, MI (US); Matthew A. Wiles, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 890 days.

(21) Appl. No.: 12/400,848

(22) Filed: Mar. 10, 2009

(65) Prior Publication Data

US 2009/0229565 A1 Sep. 17, 2009

Related U.S. Application Data

(60) Provisional application No. 61/035,813, filed on Mar. 12, 2008.

(51) Int. Cl.
*F02B 5/00* (2006.01)
*F02B 3/04* (2006.01)

(52) U.S. Cl. ..... 701/104; 123/305

(58) Field of Classification Search ..... 123/295, 123/305, 443, 478; 701/103, 104
See application file for complete search history.

(56) References Cited

U.S. PATENT DOCUMENTS

| | | | | |
|---|---|---|---|---|
| 5,979,397 | A | 11/1999 | Machida et al. | |
| 6,155,227 | A | 12/2000 | Shimada et al. | |
| 6,390,054 | B1 * | 5/2002 | Yang | 123/295 |
| 6,467,451 | B1 * | 10/2002 | Volz et al. | 123/295 |
| 6,510,835 | B1 * | 1/2003 | Mizuno et al. | 123/295 |
| 7,004,156 | B2 * | 2/2006 | Lee et al. | 123/698 |
| 7,299,784 | B2 * | 11/2007 | Uchida et al. | 123/305 |
| 7,370,633 | B2 * | 5/2008 | Kang et al. | 123/305 |
| 7,565,892 | B1 * | 7/2009 | Cleary et al. | 123/295 |
| 7,698,046 | B2 * | 4/2010 | Sauer et al. | 701/103 |
| 7,805,237 | B2 * | 9/2010 | Boehme et al. | 701/104 |
| 7,917,280 | B2 * | 3/2011 | Haering et al. | 701/103 |
| 7,966,991 | B2 * | 6/2011 | Kang et al. | 123/305 |
| 2006/0064228 | A1 * | 3/2006 | Huang | 701/104 |
| 2006/0196469 | A1 * | 9/2006 | Kuo et al. | 123/305 |
| 2009/0198431 | A1 * | 8/2009 | Cleary et al. | 701/103 |
| 2009/0234556 | A1 * | 9/2009 | Kang et al. | 701/102 |

FOREIGN PATENT DOCUMENTS

| | | | |
|---|---|---|---|
| EP | 0882877 | A2 | 12/1998 |
| EP | 0889219 | A2 | 1/1999 |
| JP | 11-062679 | A | 3/1999 |

* cited by examiner

*Primary Examiner* — Thomas Moulis

(57) ABSTRACT

Transitioning between combustion modes includes an intermediate combustion mode. Transitions are controlled in accordance with a preferred fuel mass and permissible fuel mass ranges corresponding to changing intake airflow.

20 Claims, 8 Drawing Sheets

METHOD FOR CONTROLLING COMBUSTION MODE TRANSITIONS FOR AN INTERNAL COMBUSTION ENGINE

CROSS REFERENCE TO RELATED APPLICATIONS

This application claims the benefit of U.S. Provisional Application No. 61/035,813 filed on Mar. 12, 2008 which is hereby incorporated herein by reference.

TECHNICAL FIELD

This disclosure relates to operation and control of internal combustion engines operative in spark-ignition and controlled auto-ignition (HCCI) combustion modes.

BACKGROUND

The statements in this section merely provide background information related to the present disclosure and may not constitute prior art.

Known spark-ignition (SI) engines introduce an air/fuel mixture into each cylinder which is compressed in a compression stroke and ignited by a spark plug. Known compression ignition engines inject pressurized fuel into a combustion cylinder near top dead center (TDC) of the compression stroke which ignites upon injection. Combustion for both gasoline engines and diesel engines involves premixed or diffusion flames controlled by fluid mechanics.

SI engines can operate in a variety of different combustion modes, including a homogeneous SI combustion mode and a stratified-charge SI combustion mode. SI engines can be configured to operate in a homogeneous-charge compression-ignition combustion mode, also referred to as controlled auto-ignition combustion, under predetermined speed/load operating conditions. The controlled auto-ignition combustion comprises a distributed, flameless, auto-ignition combustion process that is controlled by oxidation chemistry. An engine operating in the controlled auto-ignition (HCCI) combustion mode has a cylinder charge that is preferably homogeneous in composition, temperature, and residual exhaust gases at intake valve closing time. Controlled auto-ignition combustion is a distributed kinetically-controlled combustion process with the engine operating at a dilute air/fuel mixture, i.e., lean of an air/fuel stoichiometric point, with relatively low peak combustion temperatures, resulting in low NOx emissions. The homogeneous air/fuel mixture minimizes occurrences of rich zones that form smoke and particulate emissions.

In a stratified-charge SI combustion mode, the engine operates at a lean air/fuel ratio with the injected fuel mass stratified in the combustion chamber with rich layers proximal to the spark plug tip and leaner air/fuel ratio areas distal thereto. Fuel injection timing is preferably close in time to spark timing to prevent the air/fuel mixture from homogenizing into a uniformly disbursed mixture. The fuel injection pulse width ends as the spark event begins or substantially prior. Upon ignition, the rich layers burn quick and efficiently. As the combustion process proceeds into the leaner areas, the flame-front cools rapidly decreasing overall combustion temperatures and reducing NOx formation.

Known controlled auto-ignition combustion strategies may include using an exhaust recompression valve strategy. The exhaust recompression valve strategy includes controlling a cylinder charge temperature by trapping hot residual gas from a previous engine cycle by adjusting valve close timing. In the exhaust recompression strategy, the exhaust valve closes before TDC and the intake valve opens after TDC creating a negative valve overlap (NVO) period in which both the exhaust and intake valves are closed, thereby trapping the exhaust gas. The opening timings of the intake and exhaust valves are preferably symmetrical relative to TDC. Both a cylinder charge composition and temperature are strongly affected by the exhaust valve closing timing. In particular, more hot residual gas from a previous cycle can be retained with earlier closing of the exhaust valve leaving less room for incoming fresh airflow, thereby increasing cylinder charge temperature and decreasing cylinder oxygen concentration.

In engine operation, the engine airflow can be controlled by selectively adjusting position of the throttle valve and adjusting opening and closing of intake valves and exhaust valves. On engine systems so equipped, opening and closing of the intake valves and exhaust valves are accomplished using a variable valve actuation system that includes variable cam phasing and a selectable multi-step valve lift, e.g., multiple-step cam lobes which provide two or more valve lift profiles. A switch in the valve lift of the multi-step valve lift mechanism is a discrete change.

When an engine operates in a controlled auto-ignition (HCCI) combustion mode, the engine control comprises lean air/fuel ratio operation with the throttle wide open to minimize engine pumping losses. When the engine operates in the SI combustion mode, the engine control preferably comprises stoichiometric air/fuel ratio operation, with the throttle valve controlled over a range of positions from 0% to 100% of the wide-open position to control intake airflow.

In an engine configured for operating in SI and controlled auto-ignition (HCCI) combustion modes, transitioning between combustion modes can be complex. The engine control module must coordinate actuation of multiple devices to provide a desired air/fuel ratio for the different modes to maintain combustion stability. During a transition between controlled auto-ignition (HCCI) combustion mode and SI combustion mode, switching the engine valve lift occurs nearly instantaneously, whereas adjusting the variable cam phasers and the throttle introduces response times that result in slower dynamics.

SUMMARY

A method for operating a spark-ignition direct-injection internal combustion engine including a controllable valvetrain having intake and exhaust valves and configured to operate in a plurality of combustion modes includes operating the engine in a first combustion mode, determining an operator torque request, initiating a transition from operating the engine in the first combustion mode to operating the engine in a second combustion mode wherein the transition includes operating the engine in an intermediate combustion mode. A preferred fuel mass associated with operating the engine in the second combustion mode to achieve the operator torque request is determined. The method further includes transitioning from operating the engine in the first combustion mode to operating the engine in the intermediate combustion mode and adjusting an injected fuel mass to correspond to the preferred fuel mass when a permissible fuel mass range for the intermediate combustion mode coincides with the preferred fuel mass. The method further includes transitioning from operating the engine in the intermediate combustion mode to operating the engine in the second combustion mode and adjusting the injected fuel mass to correspond to the preferred fuel mass when a permissible fuel mass range for the second combustion mode coincides with the preferred fuel mass.

BRIEF DESCRIPTION OF THE DRAWINGS

One or more embodiments will now be described, by way of example, with reference to the accompanying drawings, in which.

DETAILED DESCRIPTION

Figure 1:
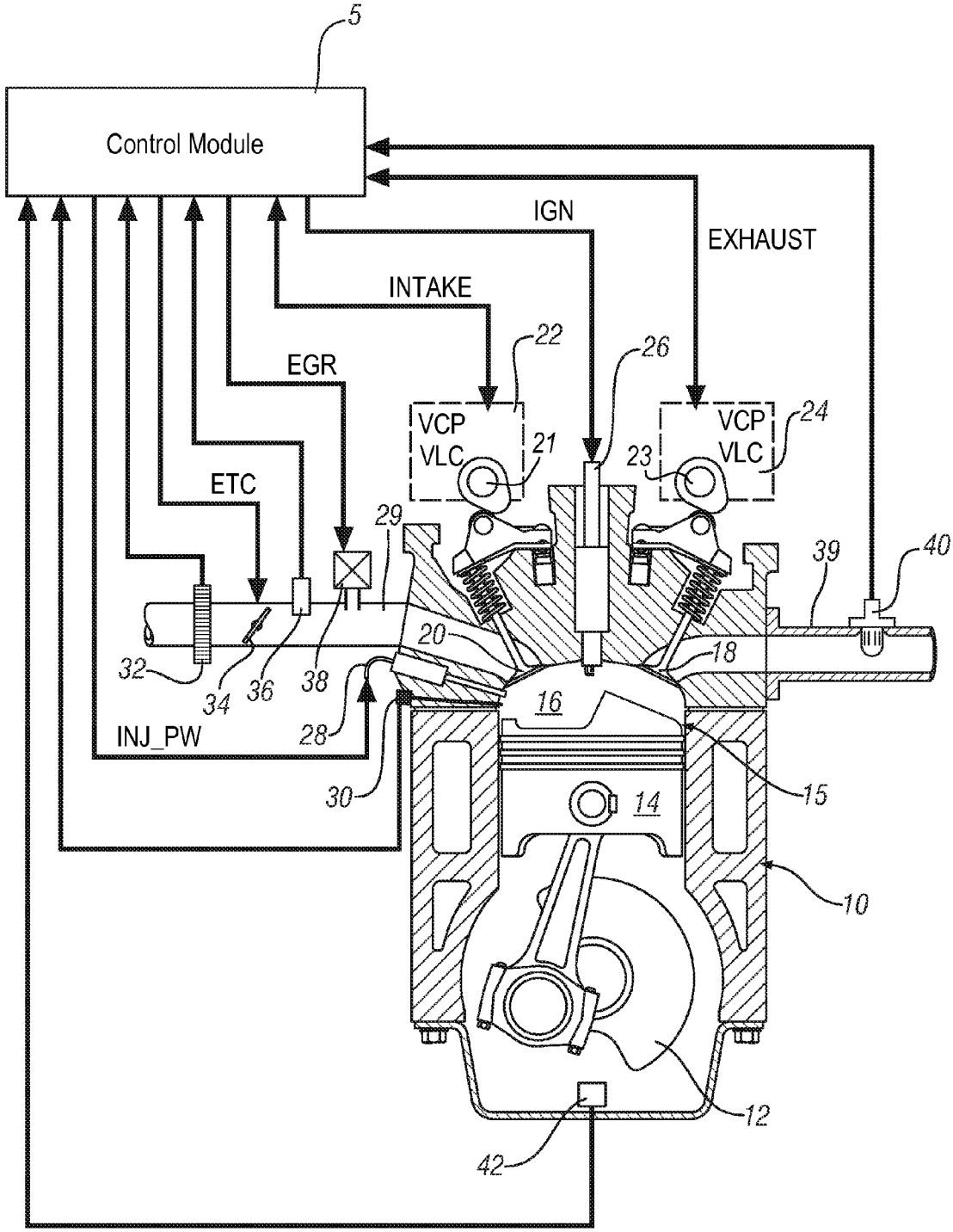
FIG. 1 is a schematic drawing of an exemplary engine system, in accordance with the present disclosure.

Referring now to the drawings, wherein the depictions are for the purpose of illustrating certain exemplary embodiments only and not for the purpose of limiting the same, FIG. 1 schematically shows an internal combustion engine 10 and an accompanying control module 5 that have been constructed in accordance with an embodiment of the disclosure. The engine 10 is selectively operative in a plurality of combustion modes, including a controlled auto-ignition (HCCI) combustion mode, a homogeneous spark-ignition (SI-H) combustion mode, and a stratified-charge spark-ignition (SC-SI) combustion mode. The engine 10 is selectively operative at a stoichiometric air/fuel ratio and at an air/fuel ratio that is primarily lean of stoichiometry. The disclosure can be applied to various internal combustion engine systems and combustion cycles.

In one embodiment the engine 10 can be coupled to a transmission device (not shown) to transmit tractive power to a driveline of a vehicle (not shown). The transmission can include a hybrid transmission including torque machines operative to transfer tractive power to a driveline.

The exemplary engine 10 comprises a multi-cylinder direct-injection four-stroke internal combustion engine having reciprocating pistons 14 slidably movable in cylinders 15 which define variable volume combustion chambers 16. Each piston 14 is connected to a rotating crankshaft 12 by which linear reciprocating motion is translated to rotational motion. An air intake system provides intake air to an intake manifold 29 which directs and distributes air into intake runners of the combustion chambers 16. The air intake system comprises airflow ductwork and devices for monitoring and controlling the airflow. The air intake devices preferably include a mass airflow sensor 32 for monitoring mass airflow and intake air temperature. A throttle valve 34 preferably comprises an electronically controlled device that is used to control airflow to the engine 10 in response to a control signal (ETC) from the control module 5. A pressure sensor 36 in the intake manifold 29 is configured to monitor manifold absolute pressure and barometric pressure. An external flow passage recirculates exhaust gases from engine exhaust to the intake manifold 29, having a flow control valve referred to as an exhaust gas recirculation (EGR) valve 38. The control module 5 is operative to control mass flow of exhaust gas to the intake manifold 29 by controlling opening of the EGR valve 38.

Airflow from the intake manifold 29 into the combustion chamber 16 is controlled by one or more intake valve(s) 20. Exhaust flow out of the combustion chamber 16 is controlled by one or more exhaust valve(s) 18 to an exhaust manifold 39. The engine 10 is equipped with systems to control and adjust openings and closings of the intake and exhaust valves 20 and 18. In one embodiment, the openings and closings of the intake and exhaust valves 20 and 18 can be controlled and adjusted by controlling intake and exhaust variable cam phasing/variable lift control (VCP/VLC) devices 22 and 24 respectively. The intake and exhaust VCP/VLC devices 22 and 24 are configured to control and operate an intake camshaft 21 and an exhaust camshaft 23, respectively. The rotations of the intake and exhaust camshafts 21 and 23 are linked to and indexed to rotation of the crankshaft 12, thus linking openings and closings of the intake and exhaust valves 20 and 18 to positions of the crankshaft 12 and the pistons 14.

The intake VCP/VLC device 22 preferably includes a mechanism operative to switch and control valve lift of the intake valve(s) 20 and variably adjust and control phasing of the intake camshaft 21 for each cylinder 15 in response to a control signal (INTAKE) from the control module 5. The exhaust VCP/VLC device 24 preferably comprises a controllable mechanism operative to variably switch and control valve lift of the exhaust valve(s) 18 and variably adjust and control phasing of the exhaust camshaft 23 for each cylinder 15 in response to a control signal (EXHAUST) from the control module 5.

The intake and exhaust VCP/VLC devices 22 and 24 each preferably includes a controllable two-step variable lift control (VLC) mechanism operative to control magnitude of valve lift, or opening, of the intake and exhaust valve(s) 20 and 18, respectively, to one of two discrete steps. The two discrete steps preferably include a low-lift valve open position (about 4-6 mm in one embodiment) preferably for load speed, low load operation, and a high-lift valve open position (about 8-13 mm in one embodiment) preferably for high speed and high load operation. The intake and exhaust VCP/VLC devices 22 and 24 each preferably includes a variable cam phasing (VCP) mechanism to control and adjust phasing (i.e., relative timing) of opening and closing of the intake valve(s) 20 and the exhaust valve(s) 18 respectively. Adjusting the phasing refers to shifting opening times of the intake and exhaust valve(s) 20 and 18 relative to positions of the crankshaft 12 and the piston 14 in the respective cylinder 15. The VCP mechanisms of the intake and exhaust VCP/VLC devices 22 and 24 each preferably has a range of phasing authority of about 60°-90° of crank rotation, thus permitting the control module 5 to advance or retard opening and closing of one of intake and exhaust valve(s) 20 and 18 relative to position of the piston 14 for each cylinder 15. The range of phasing authority is defined and limited by the intake and exhaust VCP/VLC devices 22 and 24. The intake and exhaust VCP/VLC devices 22 and 24 include camshaft position sensors (not shown) to determine rotational positions of the intake and the exhaust camshafts 21 and 23. The VCP/VLC devices 22 and 24 are actuated using one of electro-hydraulic, hydraulic, and electric control force, controlled by the control module 5.

The engine 10 includes a fuel injection system, comprising a plurality of high-pressure fuel injectors 28 each configured to directly inject a mass of fuel into one of the combustion chambers 16 in response to a signal from the control module 5. The fuel injectors 28 are supplied pressurized fuel from a fuel distribution system (not shown).

The engine 10 includes a spark-ignition system (not shown) by which spark energy can be provided to a spark plug 26 for igniting or assisting in igniting cylinder charges in each of the combustion chambers 16 in response to a signal (IGN) from the control module 5.

The engine 10 is equipped with various sensing devices for monitoring engine operation, including a crank sensor 42 having output RPM and operative to monitor crankshaft rotational position, i.e., crank angle and speed, in one embodiment a combustion sensor 30 configured to monitor combustion, and an exhaust gas sensor 40 configured to monitor exhaust gases, typically an air/fuel ratio sensor. The combustion sensor 30 comprises a sensor device operative to monitor a state of a combustion parameter and is depicted as a cylinder pressure sensor operative to monitor in-cylinder combustion pressure. The output of the combustion sensor 30 and the crank sensor 42 are monitored by the control module 5 which determines combustion phasing, i.e., timing of combustion pressure relative to the crank angle of the crankshaft 12 for each cylinder 15 for each combustion cycle. The combustion sensor 30 can also be monitored by the control module 5 to determine a mean-effective-pressure (IMEP) for each cylinder 15 for each combustion cycle. Preferably, the engine 10 and control module 5 are mechanized to monitor and determine states of IMEP for each of the engine cylinders 15 during each cylinder firing event. Alternatively, other sensing systems can be used to monitor states of other combustion parameters within the scope of the disclosure, e.g., ion-sense ignition systems, and non-intrusive cylinder pressure sensors.

The control module 5 is preferably a general-purpose digital computer comprising a microprocessor or central processing unit, storage mediums comprising non-volatile memory including read only memory and electrically programmable read only memory, random access memory, a high speed clock, analog to digital and digital to analog circuitry, and input/output circuitry and devices and appropriate signal conditioning and buffer circuitry. The control module has a set of control algorithms, comprising resident program instructions and calibrations stored in the non-volatile memory and executed to provide the desired functions. The algorithms are preferably executed during preset loop cycles. Algorithms are executed by the central processing unit and are operable to monitor inputs from the aforementioned sensing devices and execute control and diagnostic routines to control operation of the actuators, using preset calibrations. Loop cycles may be executed at regular intervals, for example each 3.125, 6.25, 12.5, 25 and 100 milliseconds during ongoing engine and vehicle operation. Alternatively, algorithms may be executed in response to occurrence of an event.

In operation, the control module 5 monitors inputs from the aforementioned sensors to determine states of engine parameters. The control module 5 is configured to receive input signals from an operator (e.g., via a throttle pedal and a brake pedal, not shown) to determine an operator torque request the control module 5 monitors the sensors indicating the engine speed and intake air temperature, and coolant temperature and other ambient conditions.

The control module 5 executes algorithmic code stored therein to control the aforementioned actuators to form the cylinder charge, including controlling throttle position, spark-ignition timing, fuel injection mass and timing, EGR valve position to control flow of recirculated exhaust gases, and intake and/or exhaust valve timing and phasing on engines so equipped. Valve timing and phasing can include NVO and lift of exhaust valve reopening (in an exhaust rebreathing strategy) in one embodiment. The control module 5 can operate to turn the engine 10 on and off during ongoing vehicle operation, and can operate to selectively deactivate a portion of the combustion chambers 15 or a portion of the intake and exhaust valves 20 and 18 through control of fuel and spark and valve deactivation. The control module 5 can control air/fuel ratio based upon feedback from the exhaust gas sensor 40.

During engine operation, the throttle valve 34 is preferably substantially wide-open in the controlled auto-ignition (HCCI) combustion modes, e.g., single and double injection controlled auto-ignition (HCCI) combustion modes, with the engine 10 controlled at a lean air/fuel ratio. Substantially wide-open throttle can include operating fully un-throttled, or slightly throttled to create a vacuum in the intake manifold 29 to effect EGR flow. In one embodiment, in-cylinder EGR mass is controlled to a high dilution rate, e.g., greater than 40% of cylinder air charge. The intake and exhaust valves 20 and 18 are in the low-lift valve position and the intake and exhaust lift timing operate with NVO. One or more fuel injection events can be executed during an engine cycle including at least one injection during a compression phase.

During engine operation in the homogeneous spark-ignition (SI-H) combustion mode, the throttle valve 34 is controlled to regulate engine airflow. The engine 10 is controlled to a stoichiometric air/fuel ratio, and the intake and exhaust valves 20 and 18 are in the high-lift valve open position and the intake and exhaust cam phasing operate with a positive valve overlap. Preferably, a fuel injection event is executed during compression phase of each engine cycle, preferably substantially before TDC. Spark ignition is preferably discharged at a predetermined timing relative to TDC to achieve a mean-best-torque subsequent to the fuel injection when air charge within the cylinder is substantially homogeneous.

A stratified-charge spark-ignition (SC-SI) combustion mode includes operating substantially lean of stoichiometry. Fuel injection timing is preferably close in time to the spark ignition timing to prevent the air/fuel mixture from homogenizing into a uniformly disbursed mixture. The injected fuel mass is injected in the combustion chamber 15 with rich layers around the spark plug and leaner air/fuel ratio areas further out at the time of spark ignition.

Figure 2:
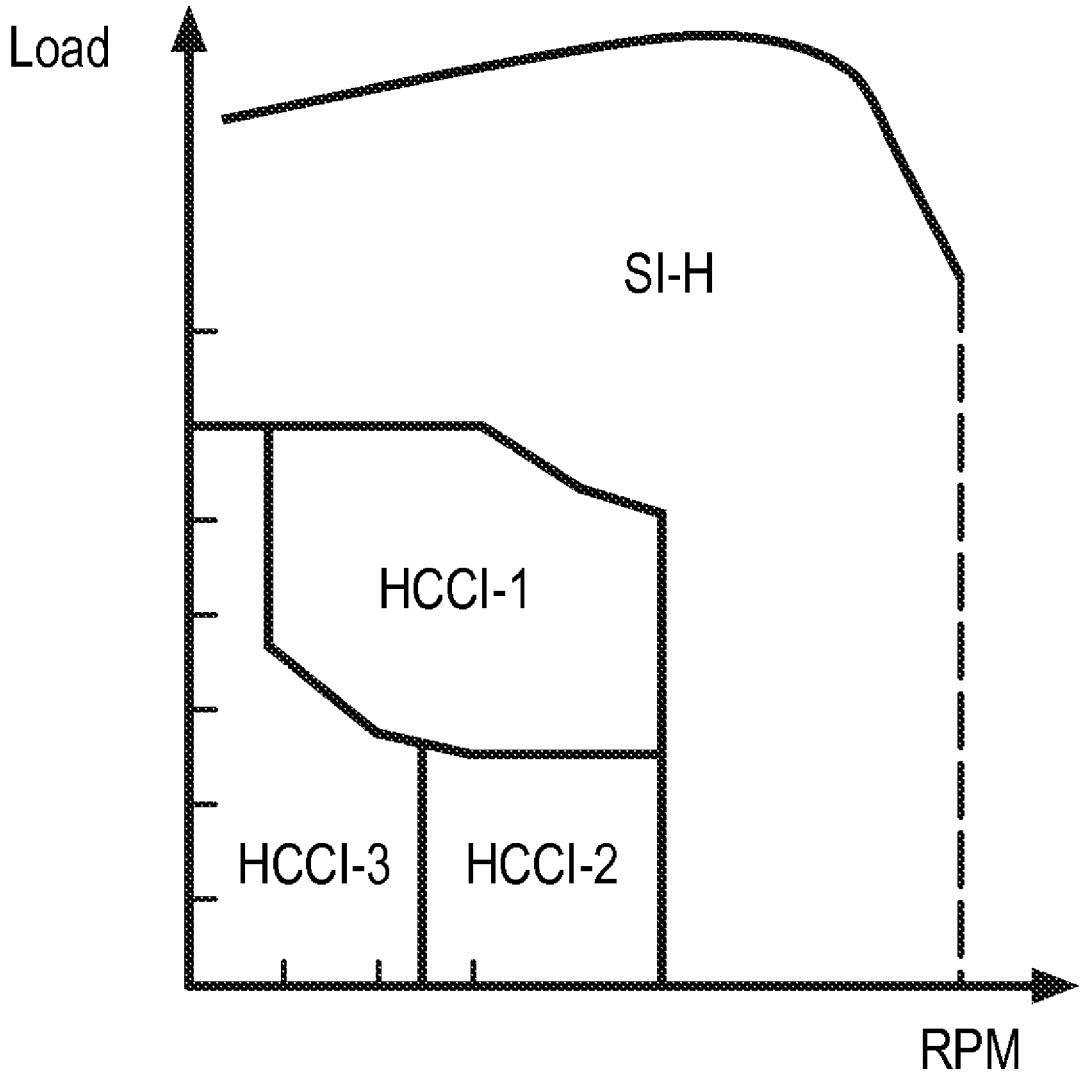
FIG. 2 graphically illustrates exemplary speed and load operating zones for various combustion modes, in accordance with the present disclosure.

FIG. 2 schematically depicts preferred combustion modes including the spark-ignition and controlled auto-ignition (HCCI) combustion modes associated with identified engine operating zones. The engine operating zones are defined by and corresponding to states of engine parameters, in this embodiment comprising engine speed and load. The engine load can be derived from engine parameters including the fuel flow and the intake manifold pressure. The combustion modes preferably include the homogeneous spark-ignition (SI-H) combustion mode, a first controlled auto-ignition (HCCI) combustion mode (HCCI-1), a second controlled auto-ignition (HCCI) combustion mode (HCCI-2), and a third controlled auto-ignition (HCCI) combustion mode (HCCI-3). The first, second, and third controlled auto-ignition (HCCI) combustion modes are differentiated by the fuel injection strategies. Preferably, each combustion mode is associated with a fuel injection strategy, e.g., the first controlled auto-ignition (HCCI) combustion mode may be associated with a single injection fuel injection strategy. The preferred combustion mode associated with the engine operating zone is predetermined based upon a specific hardware application and engine operating parameters, including combustion stability, fuel consumption, emissions, engine torque output, and others. Boundaries for the engine operating zones that define the preferred combustion mode are preferably precalibrated and stored in the control module 5 in one embodiment. The control module 5 transitions engine operation to the preferred combustion mode associated with the engine 10 to increase fuel efficiencies and engine stability, and/or decrease emissions. A change in one of the engine parameters, e.g., speed and load, can effect a change in the engine operating zone. The control module 5 commands a change in the preferred combustion mode associated with a change in the engine operating zone.

During combustion mode transitions, the engine 10 is controlled to operate at a preferred air/fuel ratio and the intake airflow is controlled to achieve the preferred air/fuel ratio. This includes estimating a cylinder air charge based upon engine operation in the selected combustion mode. The throttle valve 34 and intake and exhaust VCP/VLC devices 22 and 24 are controlled to achieve an intake airflow based upon the estimated cylinder air charge, including during a transition between the spark-ignition and controlled auto-ignition (HCCI) combustion modes. Airflow is controlled by adjusting the throttle valve 34 and the intake and exhaust VCP/VLC devices 22 and 24 to control the opening timing and profiles of the intake and exhaust valve(s) 20 and 18. Operation in the two combustion modes requires different settings for the intake and exhaust VCP/VLC devices 22 and 24 in terms of valve timing and profiles of the intake and exhaust valve(s) 20 and 18 and the throttle valve 34 for throttle position.

During a transition from the controlled auto-ignition (HCCI) combustion mode to the homogeneous spark-ignition (SI-H) combustion mode, the engine 10 transitions to operate at a stoichiometric air/fuel ratio and the airflow is controlled to achieve the stoichiometric air/fuel ratio. The control module 5 commands the throttle 34 to initiate a predetermined closing trajectory and commands the intake and exhaust VCP/VLC systems 22 and 24 to adjust the intake and exhaust cam phasers to adjust timing of opening and closing of the intake and exhaust valves 20 and 18, thereby decreasing manifold pressure. The intake and exhaust VCP/VLC systems 22 and 24 switch the intake and exhaust valves 20 and 18 from the low-lift valve position to a high-lift valve position, thereby increasing airflow. Injected fuel mass corresponds to engine load.

During a transition from the homogeneous spark-ignition (SI-H) combustion mode to the controlled auto-ignition (HCCI) combustion mode, the engine 10 transitions to operate at a lean air/fuel ratio and the airflow is controlled to achieve the lean air/fuel ratio. The control module 5 commands the throttle 34 to initiate a predetermined opening trajectory, thereby increasing manifold pressure. Airflow subsequently increases due to the increasing manifold pressure until the VLC portion of the intake and exhaust VCP/VLC systems 22 and 24 switches the intake and exhaust valves 20 and 18 from the high-lift valve position to the low-lift valve position. Injected fuel mass corresponds to engine load.

Figure 3:
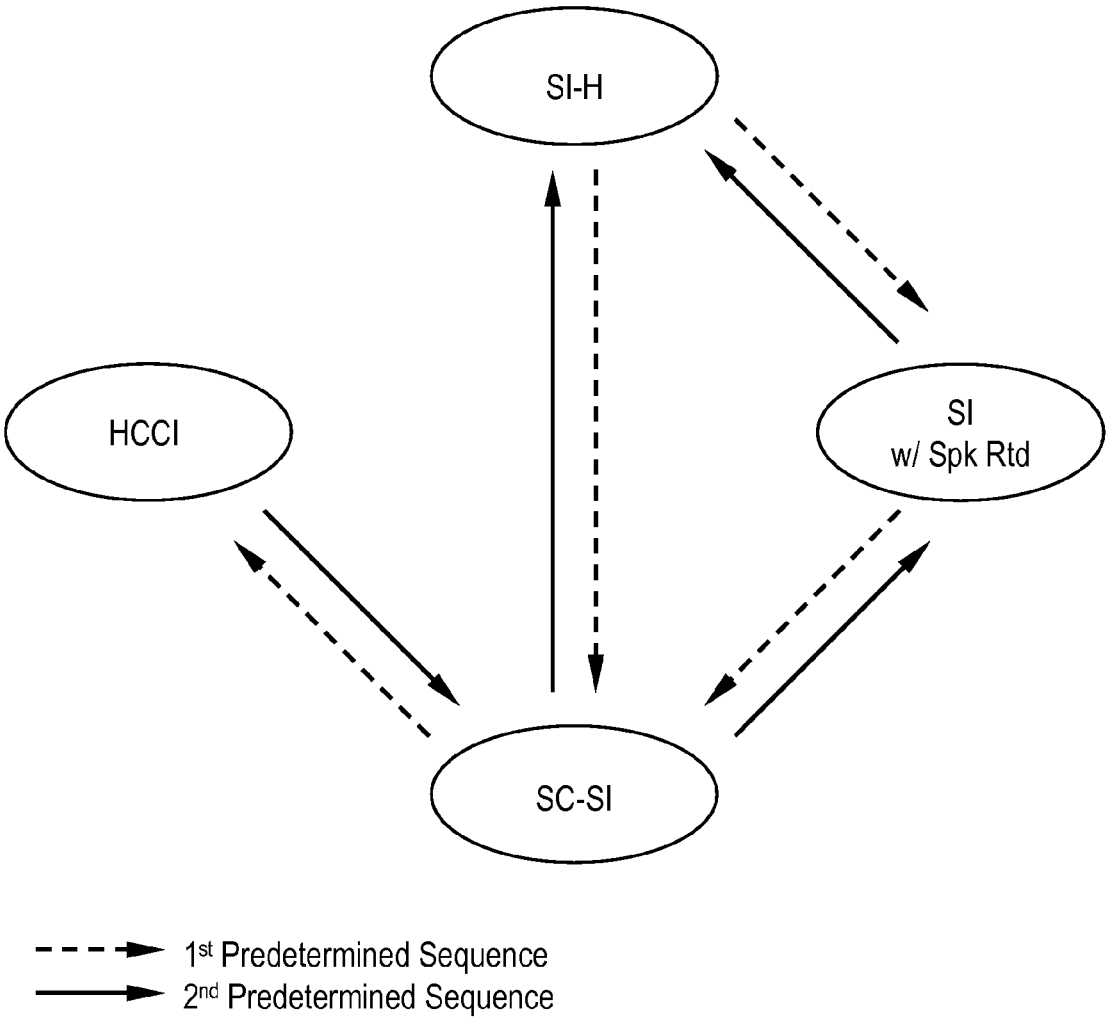
FIG. 3 is a control scheme, in accordance with the present disclosure.

FIG. 3 shows a control flow chart for preferred combustion mode transitions between the homogeneous spark-ignition (SI-H) combustion mode and the controlled auto-ignition (HCCI) combustion mode. The engine 10 transitions between the homogeneous spark-ignition (SI-H) combustion mode and the controlled auto-ignition (HCCI) combustion mode according to predetermined sequences. For transitions from the homogeneous spark-ignition (SI-H) combustion mode to the controlled auto-ignition (HCCI) combustion mode, the engine 10 transitions according to a first predetermined sequence. The first predetermined sequence includes operating the engine 10 in an intermediate stratified-charge spark-ignition (SC-SI) combustion mode. Additionally, the first predetermined sequence can include retarding spark timing to achieve a consistent torque output in the homogeneous spark-ignition (SI-H) combustion mode, i.e., a retarded spark spark-ignition combustion mode (SI w/Spk Rt). For transitions from the controlled auto-ignition (HCCI) combustion mode to the homogeneous spark-ignition (SI-H) combustion mode, the engine 10 transitions according to a second predetermined sequence. The second predetermined sequence includes operating the engine 10 in an intermediate stratified-charge spark-ignition (SC-SI) combustion mode. Additionally, the second predetermined sequence can include operating the engine 10 in the retarded spark spark-ignition combustion mode (SI w/Spk Rtd).

The control module 5 transitions engine operation to the preferred combustion mode associated with the engine 10 to increase fuel efficiencies and engine stability, and/or decrease emissions. A change in one of the engine parameters, e.g., speed and load, can effect a change in the engine operating zone. The control module 5 commands a change in the preferred combustion mode associated with a change in the engine operating zone. Each transition between the homogeneous spark-ignition (SI-H) combustion mode and the auto-ignition combustion mode includes an intermediate operation in the stratified-charge spark-ignition (SC-SI) combustion mode.

Figure 4A:
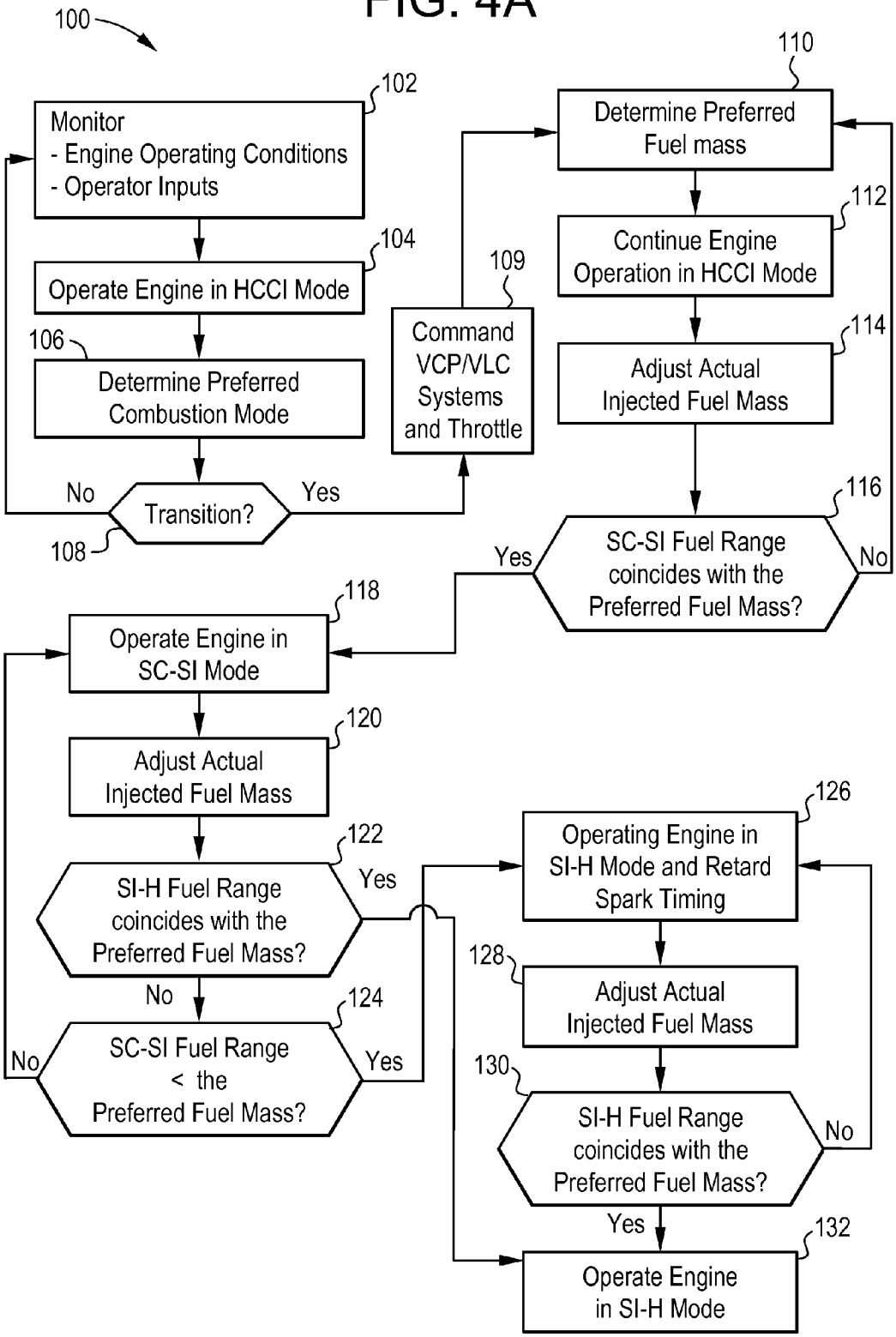
FIGS. 4A, 4B are control schemes, in accordance with the present disclosure.
Figure 4B:
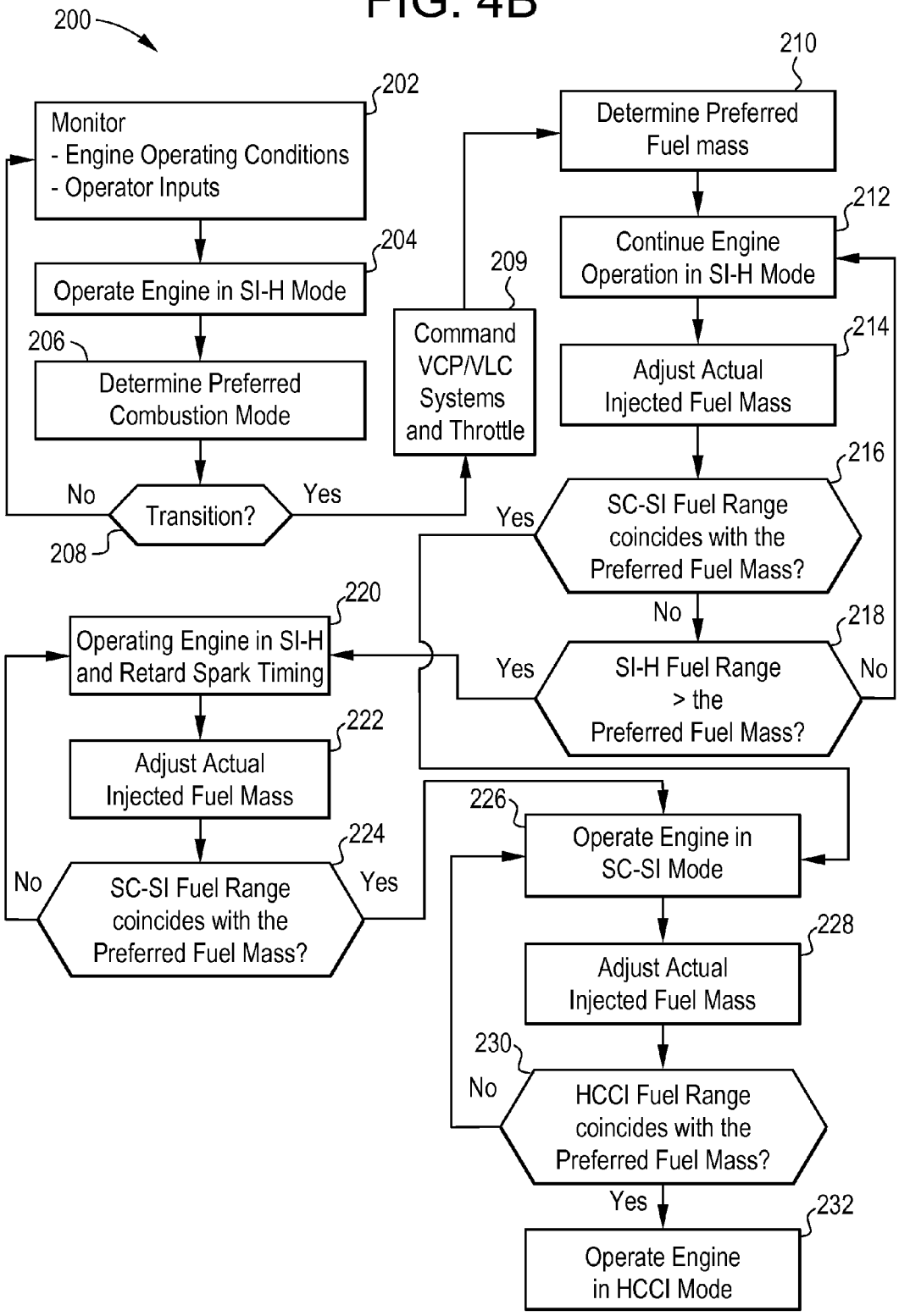
Figure 6:
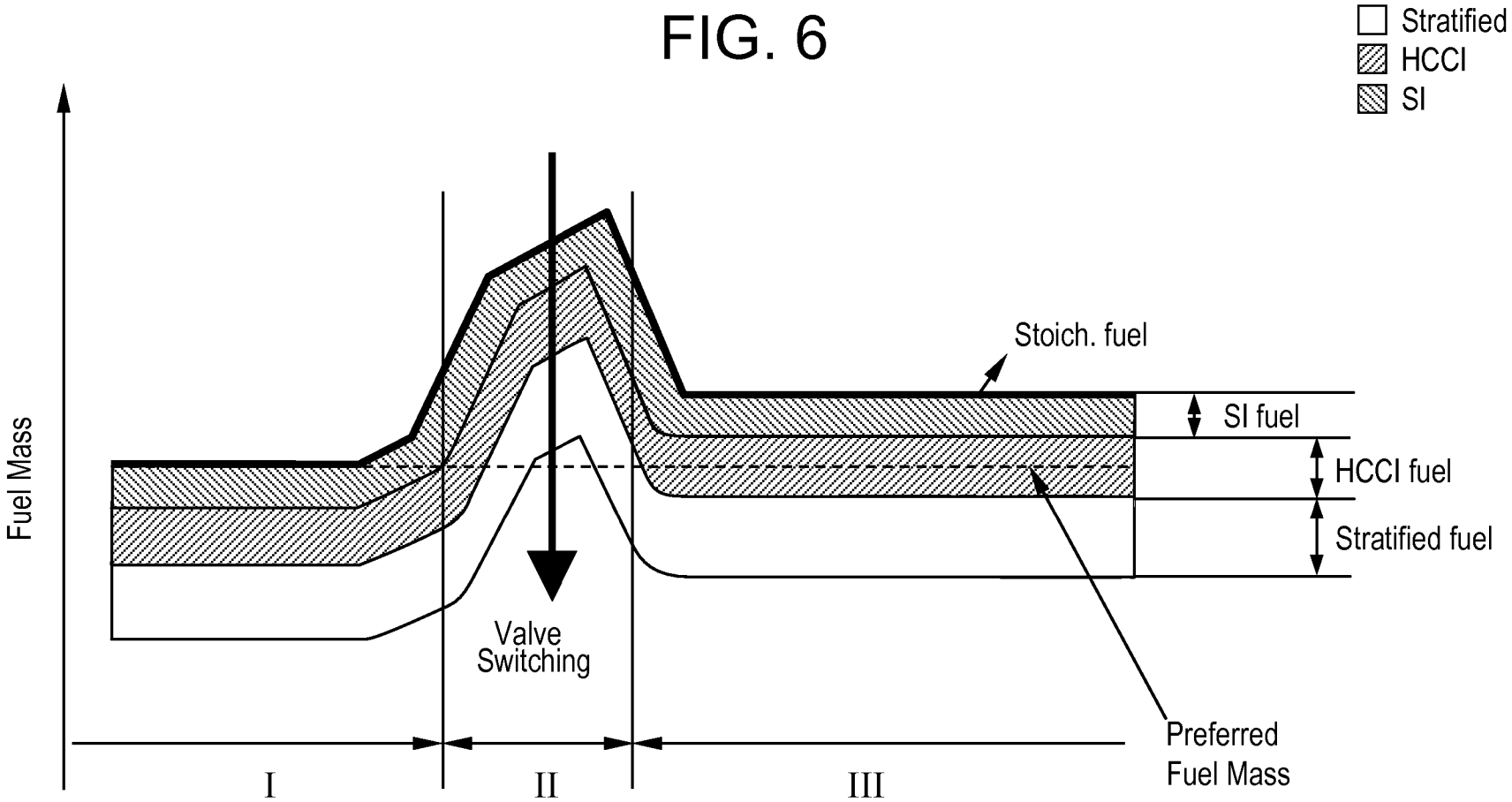
FIG. 6 graphically illustrates exemplary permissible fuel mass ranges for a plurality of combustion modes, in accordance with the present disclosure.

FIGS. 4A and 4B are control flow charts showing first and second control schemes 100 and 200 to transition engine operation between combustion modes. A change in the engine operating zone, e.g., due to a change in an operator torque request, can initiate a transition from operating the engine 10 in a first combustion mode to operating the engine 10 in a second combustion mode. Each transition includes operating in an intermediate combustion mode. Engine operation includes determining a preferred fuel mass associated with operating the engine in the second combustion mode to achieve the operator torque request. In operation, transitions are commanded in the intake and exhaust VCP/VLC devices 22 and 24 associated with operating in the second combustion mode, thus affecting intake airflow. The injected fuel mass is adjusted to maintain combustion stability while operating in the first combustion mode and corresponding to a permissible fuel mass range for operating in the first combustion mode. FIG. 6 describes permissible fuel mass ranges for each of the combustion modes.

The engine 10 transitions to operating in the intermediate combustion mode, i.e., the stratified-charge spark-ignition (SC-SI) combustion mode including adjusting the injected fuel to correspond to the preferred fuel mass when the preferred fuel mass is within a permissible fuel mass range for the intermediate combustion mode operating at the presently occurring intake airflow. Transitions continue to be commanded in the intake and exhaust VCP/VLC devices 22 and 24 associated with operating in the second combustion mode, thus continuing to affect intake airflow. The injected fuel mass is adjusted to maintain combustion stability while operating in the intermediate combustion mode and corresponding to a permissible fuel mass range for operating in the intermediate combustion mode.

The engine 10 transitions to operating in the second combustion mode including adjusting the injected fuel mass to correspond to the preferred fuel mass when the preferred fuel mass is within a permissible fuel mass range for the second combustion mode operating at the presently occurring intake airflow. Transitions continue to be commanded in the intake and exhaust VCP/VLC devices 22 and 24 associated with operating in the second combustion mode, thus continuing to affect intake airflow. The injected fuel mass is adjusted to maintain combustion stability while operating in the second combustion mode and corresponding to a permissible fuel mass range for operating in the intermediate combustion mode. Spark ignition timing can be adjusting to reduce engine torque output.

It should be recognized that the functions performed may be combined in one or more devices, e.g., implemented in software, hardware, application-specific integrated circuitry, and/or one or more control algorithms and associated calibrations stored in a memory device and executed in the control module 5.

FIG. 4A shows the first control scheme 100, descriptive of a transition from the controlled auto-ignition (HCCI) combustion mode to the homogeneous spark-ignition (SI-H) combustion mode. The first control scheme 100 monitors operator inputs and engine operating conditions (102). Monitoring engine conditions includes monitoring an engine operating point comprising engine speed and load. Alternatively, desired engine speed and load can be monitored. Operator inputs can include e.g., an accelerator pedal to determine an operator torque request as described hereinabove. The engine 10 operates in a currently selected combustion mode, e.g., the controlled auto-ignition (HCCI) combustion mode 104.

A preferred combustion mode associated with a preferred operating zone is determined based upon the monitored engine speed and load, or, alternatively, the desired engine speed and load (106). The first control scheme 100 determines whether to transition engine operation from the controlled auto-ignition (HCCI) combustion mode to the homogeneous spark-ignition (SI-H) combustion mode based upon the preferred combustion mode associated with the preferred operating zone and the present operating zone (108). If the present operating zone corresponds to the preferred operating zone, i.e., both the present operating zone and the preferred operating zone correspond to the same combustion mode, then no combustion mode transition is initiated. If the present operating zone does not correspond to the preferred operating zone, then a combustion mode transition is initiated. During the transition, the control module coordinates actuation of multiple devices, including signaling the throttle 34, the intake and exhaust VCP/VLC systems 22 and 24 to adjust the intake and exhaust cam phasers and the intake and exhaust valves 20 and 18. Valve lift switches occur nearly instantaneously, while the intake and exhaust cam phasers and pressure in the manifold have slower dynamics.

FIG. 4B shows the second control scheme 200, descriptive of a transition from the homogeneous spark-ignition (SI-H) combustion mode to the controlled auto-ignition (HCCI) combustion mode. The second control schemes 200 monitors operator inputs and engine operating conditions (202). Monitoring engine conditions includes monitoring an engine operating point comprising engine speed and load. Alternatively, desired engine speed and load can be monitored. Operator inputs can include e.g., an accelerator pedal to determine an operator torque request as described hereinabove. The engine 10 operates in a currently selected combustion mode, e.g., the homogeneous spark-ignition (SI-H) combustion mode 204.

A preferred combustion mode associated with a preferred operating zone is determined based upon the monitored engine speed and load, or, alternatively, the desired engine speed and load (206). The second control schemes 200 determines whether to transition engine operation from the homogeneous spark-ignition (SI-H) combustion mode to the controlled auto-ignition (HCCI) combustion mode based upon the preferred combustion mode associated with the preferred operating zone and a present operating zone (208). If the present operating zone corresponds to the preferred operating zone, i.e., both the currently selected operating zone and the preferred operating zone correspond to the same combustion mode, then no combustion mode transition is initiated. If the present operating zone does not correspond to the preferred operating zone, then a combustion mode transition is initiated. During the transition, the control module 5 coordinates actuation of multiple devices, including signaling the throttle 34, the intake and exhaust VCP/VLC systems 22 and 24 to adjust the intake and exhaust cam phasers and the intake and exhaust valves 20 and 18. Valve lift switches occur nearly instantaneously, while the intake and exhaust cam phasers and pressure in the manifold have slower dynamics.

Figure 5:
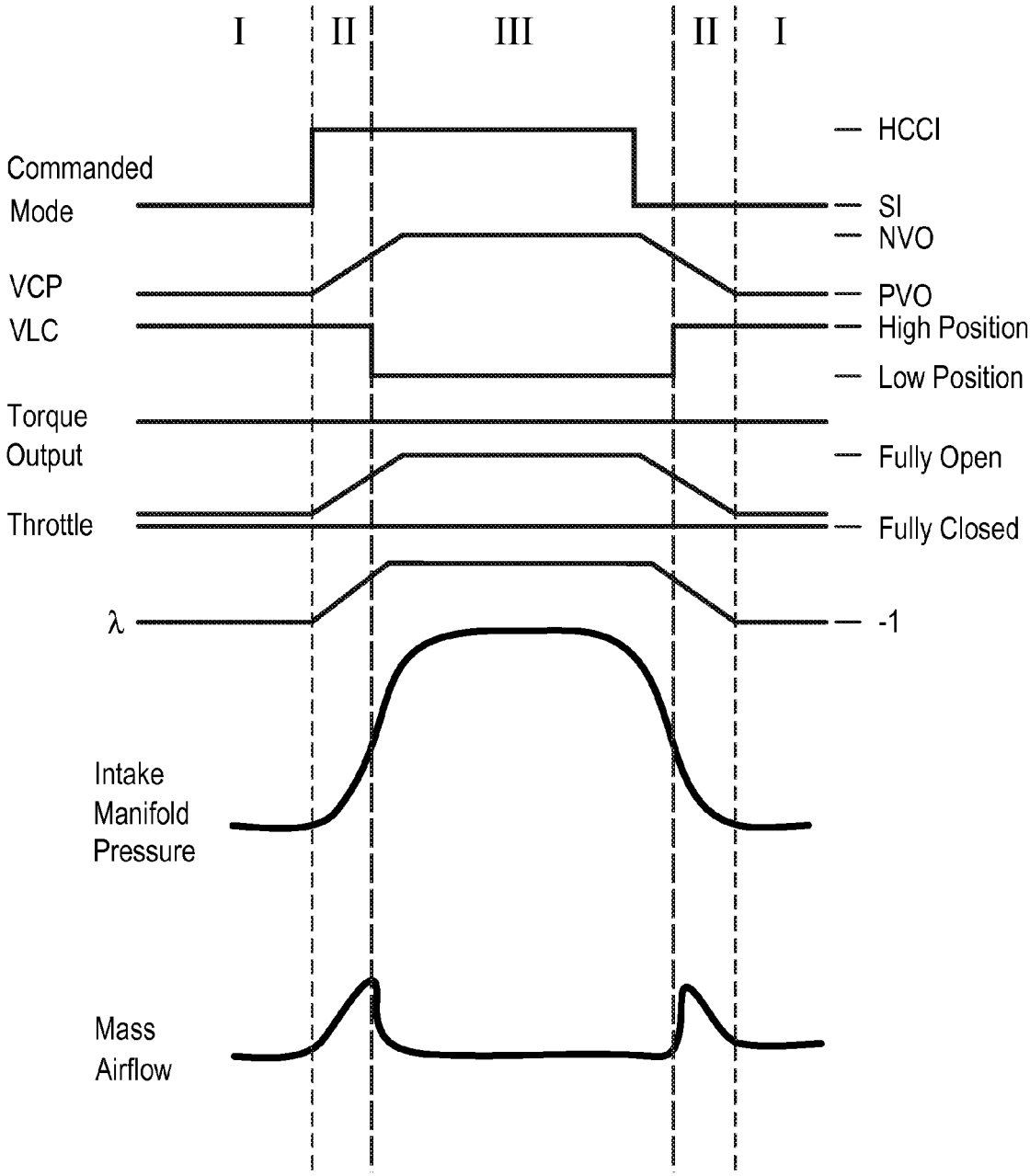
FIG. 5 graphically illustrates actuator commands and corresponding states of engine parameters during combustion mode transitions, in accordance with the present disclosure.

FIG. 5 graphically illustrates engine operating conditions, engine actuation commands, and engine actuation positions during combustion mode transitions. As FIG. 5 shows, during a transition from the homogeneous spark-ignition (SI-H) combustion mode to the controlled auto-ignition (HCCI) combustion mode, airflow temporally increases. The increased airflow is caused by increasing manifold pressure. Airflow thereafter decreases when the intake and exhaust VCP/VLC systems 22 and 24 switch the intake and exhaust valves 20 and 18 from the high-lift valve position to the low-lift valve position. Similarly, during a transition from the controlled auto-ignition (HCCI) combustion mode to the homogeneous spark-ignition (SI-H) combustion mode, the intake and exhaust VCP/VLC systems 22 and 24 switch the intake and exhaust valves 20 and 18 from the low-lift valve position to a high-lift valve position thereby temporally increasing airflow. Airflow temporally increases in both the controlled auto-ignition (HCCI) combustion mode to homogeneous spark-ignition (SI-H) combustion mode transition and the homogeneous spark-ignition (SI-H) combustion mode to controlled auto-ignition (HCCI) combustion mode transition. During these temporal periods of increased airflow, the engine 10 is preferably operated in an intermediate stratified-charge spark-ignition (SC-SI) combustion mode.

FIG. 6 graphically illustrates exemplary permissible fuel mass ranges for a plurality of combustion modes including the homogeneous spark-ignition (SI-H) combustion mode (SI Fuel), the controlled auto-ignition (HCCI) combustion mode (HCCI Fuel), and the stratified-charge spark-ignition (SC-SI) combustion mode (Stratified Fuel). Each combustion mode is associated with a preferred air/fuel ratio range. Therefore, for each preferred air/fuel ratio range a permissible fuel mass range can be determined based upon the monitored mass airflow. Preferably, the control module monitors the permissible fuel mass ranges, e.g., a controlled auto-ignition fuel range for the controlled auto-ignition (HCCI) combustion mode, a stratified-charge spark-ignition fuel range for the stratified-charge spark-ignition (SC-SI) combustion mode, and a spark-ignition fuel range for the homogeneous spark-ignition (SI-H) combustion mode. In one embodiment, each preferred fuel range is a fuel mass range between a minimum fuel mass and a maximum fuel mass.

As described herein above, airflow temporally fluctuates during combustion mode transitions. Preferably, the permissible fuel mass ranges fluctuate contemporaneously with the fluctuating airflow, e.g., increased airflow increases the permissible fuel mass ranges. The permissible fuel mass ranges are preferably determined based upon sensor data from the mass airflow sensor 32. A set of sensor outputs and a correlating fueling range may be determined for a particular hardware application and stored in a memory device in the control module 5. When the control module 5 receives the sensor outputs during engine operation, the sensor outputs can be determined, and the corresponding permissible fuel mass ranges determined for each of the plurality of combustion modes. As FIG. 6 depicts, when the control module 5 determines an airflow change has occurred, the fueling ranges for the respective combustion modes change.

Figure 7:
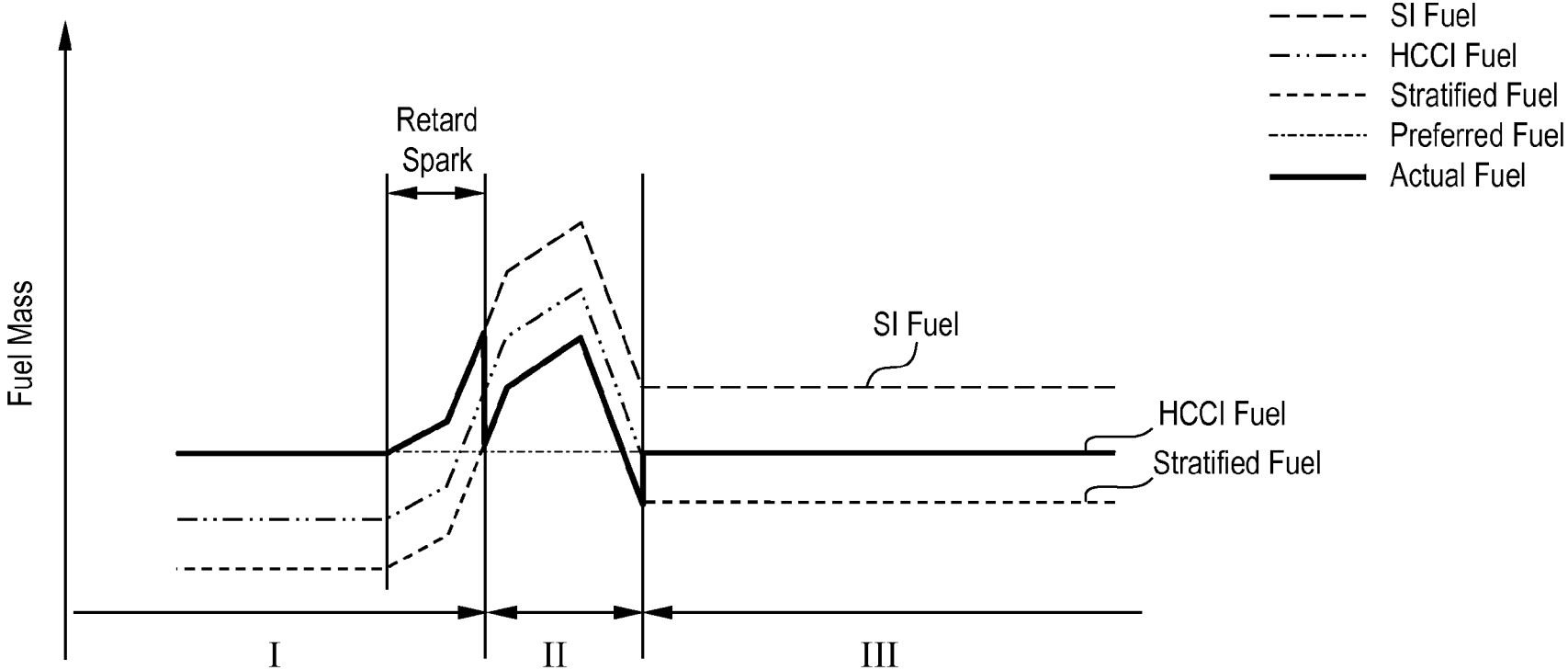
FIG. 7 graphically illustrates fuel mass as a function of time during a combustion mode transition, in accordance with the present disclosure.

FIG. 7 graphically illustrates fuel mass as a function of time during a combustion mode transition from the homogeneous spark-ignition (SI-H) combustion mode (Region I) to a controlled auto-ignition (HCCI) combustion mode (Region III) with an intermediate stratified-charge spark-ignition combustion mode (Region II). FIG. 7 depicts a preferred fuel mass and an actual fuel mass over the combustion mode transition. The first and second control schemes 100 and 200 determine a preferred fuel mass for fueling the engine 10 during a combustion mode transition. The preferred fuel mass is a desired quantity of fuel injected during each engine cycle associated with operating the engine 10 in the preferred combustion mode to achieve the operator torque request. The preferred fuel mass is preferably a fixed quantity of fuel mass injected throughout a combustion mode transition, but may fluctuate as described herein.

FIG. 4A shows combustion mode transitions using the second predetermined sequence, as previously described. The engine 10 is initially operating in the controlled auto-ignition (HCCI) combustion mode (104). The control module 5 determines the preferred combustion mode (106) and determines whether to command a combustion mode transition (108). When a transition to operating in the homogeneous spark-ignition (SI-H) combustion mode is commanded, the control module 5 initiates closing the throttle 34 and commands adjustments to the intake and exhaust VCP/VLC systems 22 and 24 to adjust the intake and exhaust cam phasers corresponding to operating in the homogeneous spark-ignition (SI-H) combustion mode, resulting in a decrease in the manifold pressure and an increase in mass airflow (109). The control module 5 determines the preferred fuel mass based upon the operator torque request (110). The control module 5 controls the engine 10 in the controlled auto-ignition (HCCI) combustion mode (112), and fuels the engine 10 responsive to the intake airflow, which is changing with the adjustments to the intake and exhaust VCP/VLC systems 22 and 24 (114).

The control module 5 monitors the intake mass airflow, the preferred fuel mass, and the permissible fuel mass ranges for stratified-charge spark-ignition, and controlled auto-ignition (HCCI) combustion modes. As mass airflow increases, the permissible fuel mass ranges for the stratified-charge spark-ignition and the homogeneous spark-ignition (SI-H) combustion modes increase. The control module 5 determines whether to transition engine operation to the stratified-charge spark-ignition (SC-SI) combustion mode based upon the preferred fuel mass and the permissible fuel mass range for the stratified-charge spark-ignition (116). When the permissible fuel mass range for the stratified-charge spark-ignition (SC-SI) combustion mode coincides with the preferred fuel mass, the control module 5 discontinues engine operation in the controlled auto-ignition (HCCI) combustion mode and initiates engine operation in the stratified-charge spark-ignition (SC-SI) combustion mode (118). Otherwise, engine operation continues within the controlled autoignition combustion mode (HCCI).

In transitioning from the controlled autoignition combustion mode (HCCI) to the stratified-charge spark-ignition (SC-SI) combustion mode (118), the control module 5 commands the intake and exhaust VCP/VLC systems 22 and 24 to switch the intake and exhaust valves 20 and 18 from the low-lift valve position to the high-lift valve position during operation in the stratified-charge spark-ignition (SC-SI) combustion mode, thus adjusting mass airflow. The control module 5 operates in the stratified-charge spark-ignition (SC-SI) combustion mode and adjusts the actual injected fuel mass corresponding to changes in the mass airflow (120). The control module 5 determines whether to transition engine operation to the homogeneous spark-ignition (SI-H) combustion mode based upon the preferred fuel mass and the permissible fuel mass range for the homogeneous spark-ignition (SI-H) combustion mode (122). When the permissible fuel mass range for the homogeneous spark-ignition (SI-H) combustion mode coincides with the preferred fuel mass, the control module 5 discontinues operating the engine 10 in the stratified-charge spark-ignition (SC-SI) combustion mode and initiates operating the engine 10 in the homogeneous spark-ignition (SI-H) combustion mode (132). If, however, while operating the engine 10 in the stratified-charge spark-ignition (SC-SI) combustion mode the permissible fuel mass range for the stratified-charge spark-ignition (SC-SI) combustion mode decreases to less than the preferred fuel mass (124), the control module 5 can transition to operating in the homogeneous spark-ignition (SI-H) combustion mode using spark-retard (126). Otherwise, the engine operation continues within the stratified-charge spark-ignition (SC-SI) combustion mode (118).

In the transition from stratified-charge spark-ignition (SC-SI) combustion mode to homogeneous spark-ignition (SI-H) combustion mode using spark-retard, the control module 5 fuels the engine 10 based upon the preferred fuel mass (128). The control module 5 continues to adjust the intake and exhaust VCP/VLC systems 22 and 24 and discontinues the spark-retard when the intake mass airflow adjusts to permit engine operation at the preferred fuel mass, i.e., when the permissible fuel mass range for the homogeneous spark-ignition (SI-H) combustion mode coincides with the preferred fuel mass (130).

FIG. 4B shows combustion mode transitions using the first predetermined sequence as previously described. The engine 10 is initially operating in the homogeneous spark-ignition (SI-H) combustion mode (204). The control module 5 determines the preferred combustion mode (206) and determines whether to command a combustion mode transition (208). When a transition to operating in the controlled auto-ignition (HCCI) combustion mode is commanded, the control module 5 initiates opening the throttle 34 and commands adjustments to the VCP/VLC systems 22 and 24 to adjust the intake and exhaust cam phasers corresponding to operating in the controlled auto-ignition (HCCI) combustion mode, resulting in an increase in the manifold pressure and mass airflow (209). The control module 5 determines the preferred fuel mass based upon the operator torque request (210). The control module 5 controls the engine 10 in the homogeneous spark-ignition (SI-H) combustion mode (212) and fuels the engine 10 responsive to the intake airflow, which is changing with the adjustments to the intake and exhaust VCP/VLC systems 22 and 24 (214).

The control module 5 monitors the intake mass airflow, the preferred fuel mass, and the permissible fuel mass ranges for the homogeneous spark-ignition (SI-H) combustion mode and the stratified-charge spark-ignition (SC-SI) combustion mode. As the mass airflow increases, the permissible fuel mass ranges for the homogeneous spark-ignition and stratified-charge spark-ignition (SC-SI) combustion modes increase. The control module 5 determines whether to transition engine operation to the stratified-charge spark-ignition (SC-SI) combustion mode based upon the preferred fuel mass and the permissible fuel mass range for the stratified-charge spark-ignition (SC-SI) combustion mode (216). When the permissible fuel mass range for the stratified-charge spark-ignition (SC-SI) combustion mode coincides with the preferred fuel mass the control module 5 discontinues engine operation in the homogeneous spark-ignition (SI-H) combustion mode and initiates engine operation in the stratified-charge spark-ignition (SC-SI) combustion mode (226). The control module 5 fuels the engine 10 based upon the preferred fuel mass (228).

If, however, while operating the engine 10 in the homogeneous spark-ignition (SI-H) combustion mode the permissible fuel range for the homogeneous spark-ignition (SI-H) combustion mode becomes greater than the preferred fuel mass (218), the control module 5 can retard spark timing and operate in the homogeneous spark-ignition (SI-H) combustion mode using spark-retard (220). The control module 5 fuels the engine 10 based upon the preferred fuel mass and the permissible fuel mass range for the homogeneous spark-ignition (SI-H) combustion mode (222). The control module 5 continues monitoring the permissible stratified-charge spark-ignition (SC-SI) fuel range and discontinues retarding the spark ignition and initiates engine operation in the stratified-charge spark-ignition (SC-SI) combustion mode when the permissible fuel mass range for the stratified-charge spark-ignition (SC-SI) combustion mode coincides with the preferred fuel mass (224).

The control module 5 commands the intake and exhaust VCP/VLC systems 22 and 24 to switch the intake and exhaust valves 20 and 18 from the high-lift valve position to the low-lift valve position during operation in the stratified-charge spark-ignition (SC-SI) combustion mode, thus adjusting mass airflow. The control module 5 operates in the stratified-charge spark-ignition (SC-SI) combustion mode and adjusts the actual injected fuel mass corresponding to changes in the mass airflow. The control module 5 determines whether to transition engine operation to the controlled auto-ignition (HCCI) combustion mode based upon the preferred fuel mass and the permissible fuel mass range for the controlled auto-ignition fuel range (230). When the intake mass airflow adjusts to permit engine operation at the preferred fuel mass, i.e., when the permissible fuel mass range for the controlled auto-ignition (HCCI) combustion mode coincides with the preferred fuel mass, the control module 5 discontinues engine operation in the stratified-charge spark-ignition (SC-SI) combustion mode and initiates engine operation in the controlled auto-ignition (HCCI) combustion mode (232).

Referring back to FIG. 7, the actual fuel mass injected into the engine 10 during combustion mode transitions for either of the first and second predetermined sequences is determined based upon the preferred fuel mass and the permissible fuel mass range of the current combustion mode corresponding to the mass airflow. The actual fuel mass can be adjusted to the preferred fuel mass when the preferred fuel range of the current combustion mode coincides with the preferred fuel mass. When the preferred fuel mass is less than the preferred fuel range of the current combustion mode, a fuel mass corresponding to a minimum fuel mass of the preferred fuel range of the current combustion mode is the actual fuel mass. When the preferred fuel mass is greater than the preferred fuel range of the current combustion mode, a fuel mass corresponding to a maximum fuel mass of the preferred fuel range of the current combustion mode is the actual fuel mass. Restated, the actual fuel mass injected into the engine 10 is not a fuel mass outside the preferred fuel range of the current combustion mode.

As FIG. 7 shows, actual fuel injected into the engine 10 during operation in the homogeneous spark-ignition (SI-H) combustion mode (Region I) increases after the preferred fuel range for the homogeneous spark-ignition (SI-H) combustion mode increases. After engine operation transitions to the stratified-charge spark-ignition (SC-SI) combustion mode (Region II), the actual fuel injected is equal to the minimum fuel mass on the stratified-charge spark-ignition fuel range. After engine operation transitions to the controlled auto-ignition (HCCI) combustion mode (Region III), the actual fuel injected is equal to the preferred fuel mass when the permissible fuel range for the controlled auto-ignition (HCCI) combustion mode coincides with the preferred fuel mass.

Alternative embodiments comprise other internal combustion engines having controllable valve opening control, including those employing multi-step valve openings and/or variable cam phasing for only the intake valves or the exhaust valves, or continuously variable valve lift, phase and duration controls.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for operating a spark-ignition direct-injection internal combustion engine including a controllable valvetrain having intake and exhaust valves and configured to operate in a plurality of combustion modes, the method comprising:

operating the engine in a first combustion mode;

determining an operator torque request;

initiating a transition from operating the engine in the first combustion mode to operating the engine in a second combustion mode, the transition including operating the engine in an intermediate combustion mode;

determining a preferred fuel mass associated with operating the engine in the second combustion mode to achieve the operator torque request;

transitioning from operating the engine in the first combustion mode to operating the engine in the intermediate combustion mode and adjusting an injected fuel mass to correspond to the preferred fuel mass when a permissible fuel mass range for the intermediate combustion mode coincides with the preferred fuel mass; and transitioning from operating the engine in the intermediate combustion mode to operating the engine in the second combustion mode and adjusting the injected fuel mass to correspond to the preferred fuel mass when a permissible fuel mass range for the second combustion mode coincides with the preferred fuel mass.

2. The method of claim 1, further comprising adjusting openings and closings of the intake and exhaust valves during operation in the first combustion mode; and adjusting the injected fuel mass corresponding to changes in airflow associated with the adjusted openings and closings of the intake and exhaust valves during operation in the first combustion mode.

3. The method of claim 1, further comprising:

adjusting openings and closings of the intake and exhaust valves during operation in the intermediate combustion mode; and adjusting the injected fuel mass corresponding to changes in airflow associated with the adjusted openings and closings of the of the engine during operation in the intermediate combustion mode.

4. The method of claim 1, wherein the injected fuel mass is adjusted based upon the preferred fuel mass and a permissible fuel mass range associated with the first combustion mode when the engine operates in the first combustion mode.

5. The method of claim 4, wherein the permissible fuel mass range for the first combustion mode is a range between a minimum fuel mass and a maximum fuel mass, and wherein the injected fuel mass is the preferred fuel mass when operating in the first combustion mode and the permissible fuel mass range for the first combustion mode coincides with the preferred fuel mass, and wherein the injected fuel mass is the minimum fuel mass when operating in the first combustion mode and the preferred fuel mass is less than the permissible fuel mass range.

6. The method of claim 5, wherein the injected fuel mass is the maximum fuel mass when operating in the first combustion mode and the preferred fuel mass is greater than the permissible fuel mass range for the first combustion mode.

7. The method of claim 1, wherein the injected fuel mass is adjusted based upon the permissible fuel mass range for the intermediate combustion mode when the engine operates in the intermediate combustion mode.

8. The method of claim 7, wherein the permissible fuel mass range for the intermediate combustion mode is a range between a minimum fuel mass and a maximum fuel mass, and wherein the injected fuel mass is the preferred fuel mass when operating in the intermediate combustion mode and the permissible fuel mass range for the intermediate combustion mode coincides with the preferred fuel mass, and wherein the injected fuel mass is the minimum fuel mass when operating in the intermediate combustion mode and the preferred fuel mass is less than the permissible fuel mass range for the intermediate combustion mode.

9. The method of claim 8, wherein the injected fuel mass is the maximum fuel mass when operating in the intermediate combustion mode and the preferred fuel mass is greater than the permissible fuel mass range for the intermediate combustion mode.

10. The method of claim 1, wherein the permissible fuel mass range for the intermediate combustion mode is determined based upon a predetermined air/fuel ratio range for the intermediate combustion mode and a monitored intake airflow, and wherein the permissible fuel mass range for the second combustion mode is determined based upon a predetermined air/fuel ratio range for the second combustion mode and the monitored intake airflow.

11. The method of claim 1, wherein the first combustion mode is a homogeneous spark-ignition combustion mode, and wherein the second combustion mode is a controlled auto-ignition combustion mode.

12. Method for operating a spark-ignition direct-injection internal combustion engine including a controllable valvetrain having intake and exhaust valves and configured to operate in a plurality of combustion modes, the method comprising:

operating the engine in a first combustion mode;

determining an operator torque request;

monitoring an intake airflow;

initiating a transition from operating the engine in the first combustion mode to operating the engine in a second combustion mode, the transition including adjusting the openings and closings of the intake and exhaust valves;

determining a preferred fuel mass associated with operating the engine in the second combustion mode to achieve the operator torque request;

transitioning from operating the engine in the first combustion mode to operating the engine in an intermediate combustion mode and adjusting an injected fuel mass to correspond to the preferred fuel mass when a permissible fuel mass range at the monitored intake airflow for the intermediate combustion mode coincides with the preferred fuel mass; and transitioning from operating the engine in the intermediate combustion mode to operating the engine in the second combustion mode and adjusting the injected fuel mass to correspond to the preferred fuel mass when a permissible fuel mass range at the monitored intake airflow for the second combustion mode coincides with the preferred fuel mass.

13. The method of claim 12, further comprising adjusting openings and closings of the intake and exhaust valves during operation in the first combustion mode; and adjusting the injected fuel mass corresponding to changes in airflow associated with the adjusted openings and closings of the intake and exhaust valves during operation in the first combustion mode.

14. The method of claim 12, further comprising:

adjusting openings and closings of the intake and exhaust valves during operation in the intermediate combustion mode; and adjusting the injected fuel mass corresponding to changes in airflow associated with the adjusted openings and closings of the intake and exhaust valves during operation in the intermediate combustion mode.

15. The method of claim 12, wherein the injected fuel mass is adjusted based upon the preferred fuel mass and a permissible fuel mass range associated with the first combustion mode when the engine operates in the first combustion mode, and wherein the injected fuel mass is adjusted based upon a permissible fuel mass range for the intermediate combustion mode when the engine operates in the intermediate combustion mode.

16. The method of claim 15, wherein the permissible fuel mass range for the first combustion mode is a range between a minimum fuel mass and a maximum fuel mass, and wherein the injected fuel mass is the preferred fuel mass when operating in the first combustion mode and the permissible fuel mass range for the first combustion mode coincides with the preferred fuel mass, and wherein the injected fuel mass is the minimum fuel mass when operating in the first combustion mode and the preferred fuel mass is less than the permissible fuel mass range.

17. The method of claim 15, wherein the permissible fuel mass range for the intermediate combustion mode is a range between a minimum fuel mass and a maximum fuel mass, and wherein the injected fuel mass is the preferred fuel mass when operating in the intermediate combustion mode and the permissible fuel mass range for the intermediate combustion mode coincides with the preferred fuel mass, and wherein the injected fuel mass is the minimum fuel mass when operating in the intermediate combustion mode and the preferred fuel mass is less than the permissible fuel mass range for the intermediate combustion mode.

18. The method of claim 12, wherein the first combustion mode is a controlled auto-ignition combustion mode, and wherein the second combustion mode is a homogeneous spark-ignition combustion mode.

19. The method of claim 18, further comprising:

monitoring an engine operating point; and wherein initiating a transition occurs based upon the engine operating point.

20. The method of claim 19, wherein initiating a transition from operating the engine in the controlled auto-ignition combustion mode to operating the engine in the homogeneous spark-ignition combustion mode occurs when the engine operating point corresponds to a predetermined engine operating zone associated with the homogeneous spark-ignition combustion mode.

* * * * *